US006364291B1

(12) United States Patent
Grant

(10) Patent No.: US 6,364,291 B1
(45) Date of Patent: Apr. 2, 2002

(54) CARBURETOR FUEL BOWL HAVING INCREASED FUEL CARRYING CAPACITY

(76) Inventor: Barry Grant, 206 Lanier Dr., Dahlonega, GA (US) 30533

( * ) Notice: Subject to any disclaimer, the term of this patent is extended or adjusted under 35 U.S.C. 154(b) by 0 days.

(21) Appl. No.: 09/487,678

(22) Filed: Jan. 19, 2000

Related U.S. Application Data

(60) Provisional application No. 60/116,299, filed on Jan. 19, 1999.

(51) Int. Cl.[7] ..... F02M 5/02
(52) U.S. Cl. ..... 261/70; 261/72.1
(58) Field of Search ..... 261/70, 72.1, 23.2

(56) References Cited

U.S. PATENT DOCUMENTS 1,718,652 A * 6/1929 Langdon ..... 261/70 X
1,748,332 A * 2/1930 Ensign ..... 261/70
2,254,850 A * 9/1941 Mallory ..... 261/70 X
3,196,926 A * 7/1965 Gartland ..... 261/70 X
4,367,181 A * 1/1983 Hack, Jr. ..... 261/70
5,283,011 A 2/1994 McClintic et al. ..... 261/23.2
5,667,730 A 9/1997 Barfield ..... 261/18.3

FOREIGN PATENT DOCUMENTS

JP 60-187747 * 9/1985 ..... 261/70

* cited by examiner

*Primary Examiner*—Richard L. Chiesa
(74) *Attorney, Agent, or Firm*—Thomas, Kayden, Horstemeyer & Risley

(57) ABSTRACT

Fuel bowl (10) is to be mounted to a metering block and to a carburetor of a high performance internal combustion engine. The fuel bowl housing (12) includes an inner fuel cavity or chamber (14) and a supplemental fuel storage chamber (44) (FIG. 1). A stuffer block (50) (FIGS. 2–6) is optionally placed in the supplemental fuel storage area so as to reduce the amount of fuel carried in the fuel bowl. As an alternative, a fuel dam (52) (FIGS. 6–10) can be placed between the inner fuel chamber (14) and the supplemental fuel chamber (44) to prevent sloshing of the fuel between the chambers and to supply a steady feed of supplemental fuel from the supplemental fuel storage chamber through the openings (82) to the inner fuel chamber (14) during high capacity use of fuel by the engine.

12 Claims, 5 Drawing Sheets

CARBURETOR FUEL BOWL HAVING INCREASED FUEL CARRYING CAPACITY

CROSS REFERENCE TO RELATED APPLICATION

Applicant claims the benefit of U.S. Provisional Patent Application Ser. No. 60/116,299 filed Jan. 19, 1999.

FIELD OF THE INVENTION

This invention relates generally to a carburetor fuel bowl. More particularly, the invention relates to a carburetor fuel bowl which has increased fuel carrying capacity such that additional fuel can be contained therein.

BACKGROUND OF THE INVENTION

Modern carburetors normally include fuel bowls that serve as local reservoirs for fuel that is supplied into the barrels of the carburetor and ultimately into the cylinders of a combustion engine. Before passing into the barrels of the carburetor, the fuel usually passes through fuel metering blocks which pre-emulsify the fuel for later atomization within the carburetor barrels. Typically, fuel is passed from the fuel bowl to the metering block through inlet jets which normally are located adjacent the bottom edge of the metering block.

In high performance applications, it normally is advantageous to increase the capacity of the fuel bowl for several reasons. First, during hard acceleration the vehicle fuel pump temporarily may be unable to supply fuel to the fuel bowl. Second, racing rules and regulations sometimes place limitations on the delivery capacity of fuel pumps that can be used by participants in particular races. Third, alternative fuels such as alcohol are consumed at increased rates that require increased holding capacity from the fuel bowls.

Currently, high capacity fuel bowls come in one of two forms. In the first known form, the fuel bowl has an oversized construction in which the length of the fuel bowl is increased so as to increase an inner volume of the fuel bowl. In the second known form, fuel bowl extensions are used in conjunction with standard sized fuel bowls to likewise increase the inner volume available for fuel storage. Although satisfying the need for increased fuel carrying capacity, known large volume fuel bowls can create problems for the user. As a first matter, the increased size of these fuel bowls causes the carburetor to extend beyond the standard accepted envelope normally provided for carburetors in engine compartments. Because of this fact, carburetors having oversized fuel bowls or fuel bowl extensions often interfere with other engine components such as air cleaners and distributors.

In addition to these component crowding difficulties, conventional high capacity fuel bowls further present problems associated with fuel uptake. As is known in the art, linear and/or lateral acceleration of a vehicle can cause the fuel within the carburetor fuel bowls to shift opposite to the direction of the acceleration. In the case of linear acceleration, this shifting of the fuel volume can have detrimental effects on the supply of fuel on both the front and rear fuel bowls. This form of acceleration forces the fuel in each fuel bowl rearwardly. Inside the rear fuel bowl, this rearward migration of the fuel can uncover the inlet jets of the fuel bowl's adjacent metering block, causing a temporary loss of fuel supply from the rear side of the carburetor. In the front fuel bowl, the rearward migration of the fuel can cause the fuel to uncontrollably flow into the front carburetor barrels, choking the engine with an unduly rich supply of fuel. In the case of lateral acceleration, large capacity fuel bowls can cause the supply of fuel from both of the fuel bowls to be temporarily lost. In oval track racing, for example, the acceleration forces exerted on the vehicle during the left-hand turns can cause the fuel in each fuel bowl to migrate to the right side of the bowl, to uncover the inlet jets.

From the above, it can be understood that it would be desirable to have a high. capacity fuel bowl that does not extend beyond the standard accepted envelope and which further prevents the above described difficulties associated with fuel migration in response to vehicle acceleration.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

FIG. 3 is a partial cross-sectional view of the fuel bowl shown in FIG. 2 taken along lines 3—3.

DETAILED DESCRIPTION

Figure 1:
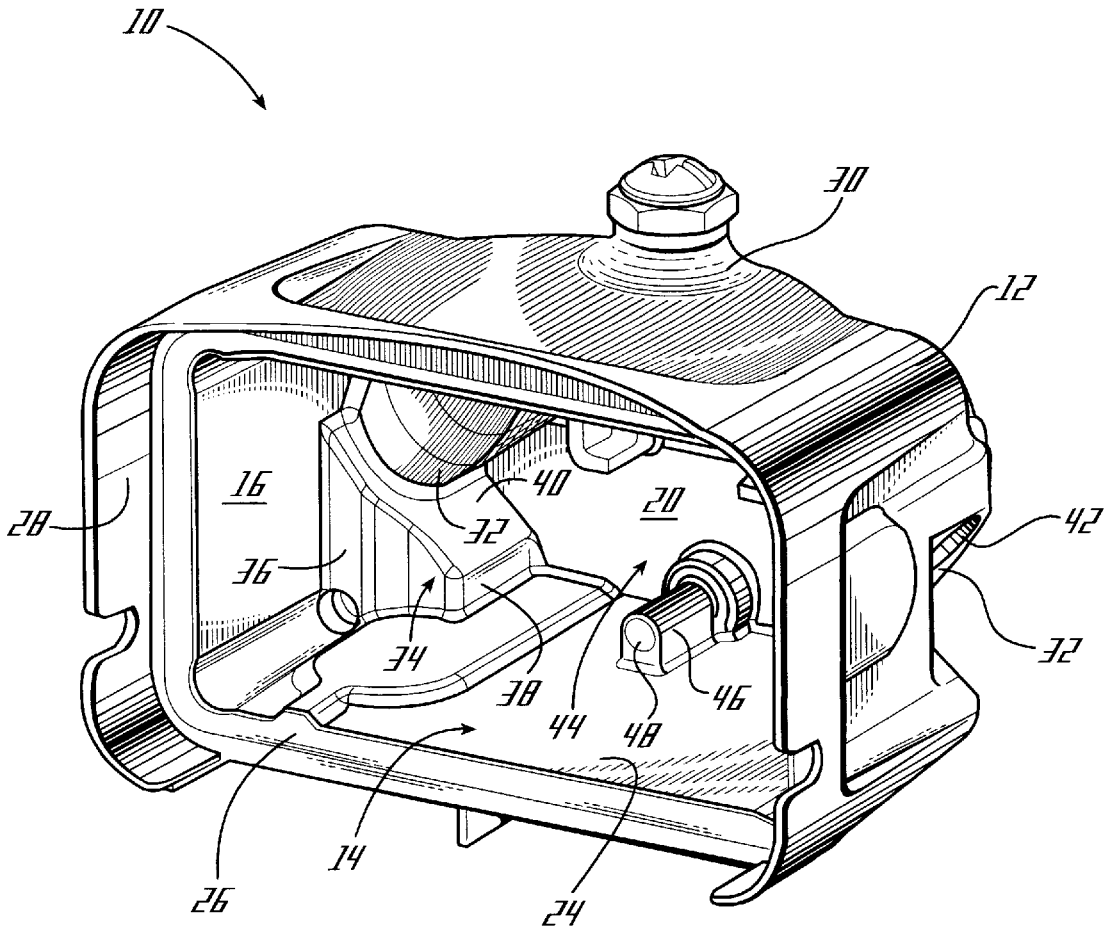
FIG. 1 is a perspective view of a carburetor fuel bowl constructed in accordance with the present invention.
Figure 1:
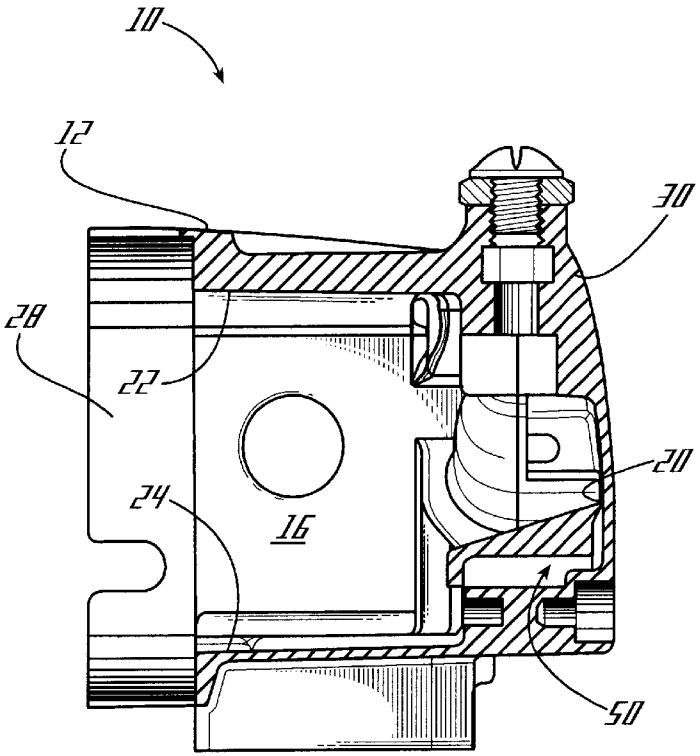
Figure 2:
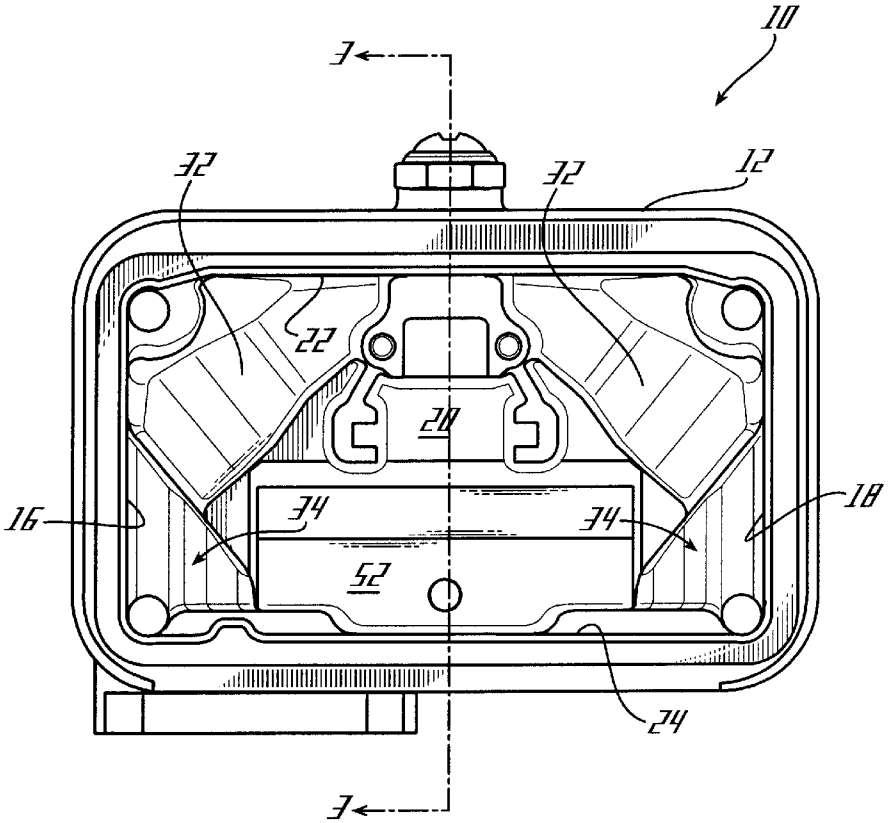
FIG. 2 is a front view of the fuel bowl shown in FIG. 1 provided with a stuffer block.

Referring now in more detail to the drawings, in which like numerals indicate like parts throughout the several views, FIG. 1 illustrates a fuel bowl 10 constructed with accordance with the present invention. As shown in this figure, the fuel bowl 10 comprises a substantially rectilinear fuel bowl housing 12 that forms an inner fuel cavity or chamber 14 in which fuel to be supplied to the carburetor via a metering block (not shown) is held. As indicated in FIG. 2, this fuel cavity 14 is defined by lateral sides 16 and 18, a rear side 20, and top and bottom sides 22 and 24 such that the fuel bowl housing 12 has an open-faced configuration. When installed on a carburetor, this open face is closed with a similarly dimensioned metering block. Formed around the periphery of the open face of the fuel bowl housing 12 is a mating surface 26 at which point the fuel bowl housing 12 contacts the metering block when the fuel bowl 10 is secured to the carburetor. Extending forwardly from the mating surface 26 is an aesthetically pleasing cowling 28.

Integrally formed with the fuel bowl housing 12 is a fuel valve housing 30 in which a fuel valve (not shown) is contained. Also integrally formed with the housing 12 is a pair of fuel inlet ports 32 shown in FIGS. 1 and 2. During operation, fuel flows through these inlet ports 32 and into the inner fuel cavity 14 via the fuel valve. Although the valve housing 30 and the fuel inlet ports 32 are described as being integrally formed with the fuel bowl housing 12, it will be appreciated that these features could, alternatively, be formed as separate parts that are individually secured to the housing. As shown most clearly in FIG. 1, the base of each fuel inlet port 32 is integrally formed with a corner structure 34. Each corner structure 34 is defined by a front surface 36, a lateral surface 38, and a top surface 40. Normally, the top surfaces 40 of the corner structure 34 are arranged in oblique orientations such as those shown in FIG. 1.

Between the two comer structures 34 is supplemental fuel storage chamber 44. This supplemental fuel storage area 44 represents a distinct advance in the art in that the space in this vicinity of conventional fuel bowls typically is occupied by the fuel bowl housing 12 and therefore is not available for additional fuel carrying. Therefore, with the present fuel bowl, high capacity fuel carrying can be obtained without the need to extend the fuel bowl beyond the standard accepted carburetor envelope. Accordingly, the problems associated with component crowding within the engine compartment is avoided with the present invention.

Formed between the comer structures 34 is a boss 46. Typically, the boss 46 is provided with a threaded opening 48 which is adapted to receive a conventional fastener (not shown) such as a screw or bolt. This boss 46 is configured and positioned for the separate and independent securement of a stuffer block 50 and a fuel dam 52. FIGS. 2 and 3 show the fuel bowl 10 of the present invention fitted with a stuffer block 50. As shown in these figures, the stuffer block 50 can be positioned within the supplemental fuel storage area 44 between the comer structures 34 for purposes which are explained below. Once placed in this position, the stuffer block 50 can be removably secured in place with a conventional fastener (not shown) such as a screw or bolt.

Figure 4:
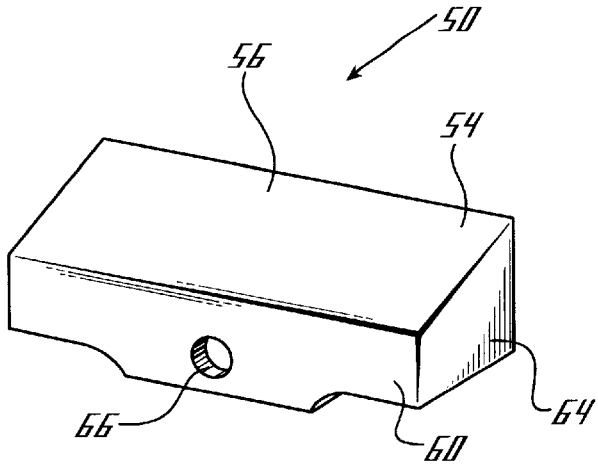
FIG. 4 is a front perspective view of the stuffer block shown in FIGS. 2–3.
Figure 5:
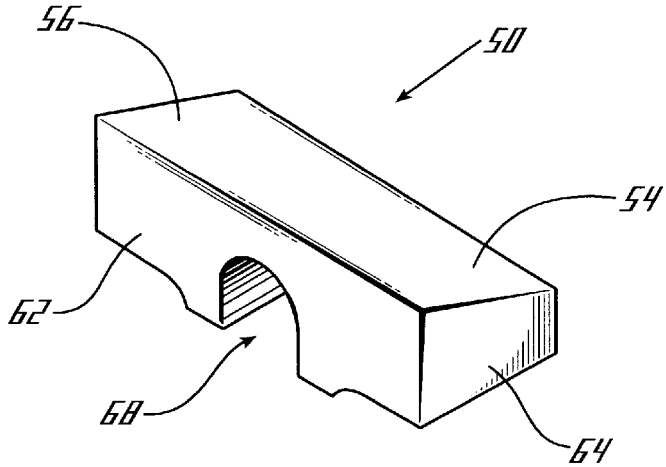
FIG. 5 is a rear perspective view of the stuffer block of FIG. 4.
Figure 6:
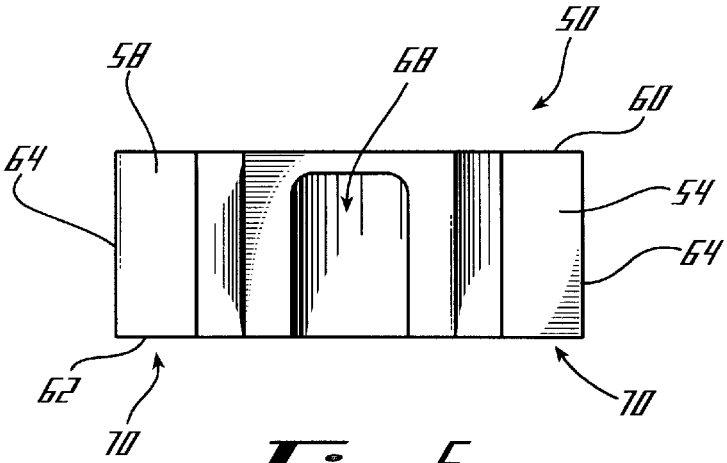
FIG. 6 is a bottom view of the stuffer block of FIGS. 4–5.

As illustrated in FIGS. 4–6, the stuffer block 50 typically comprises a solid body 54 defined by top and bottom sides 56 and 58, front and rear sides 60 and 62, and by opposed lateral sides 64. The top side 56 normally is angled relative to the bottom side 58 so as to provide for full range of motion of a float (not shown) that typically is mounted inside the fuel bowl housing 12 to gauge the level of fuel contained therein. Formed in the front side 60 of the stuffer block 50 is a fastener hole 66 through which a conventional fastener can be extended to thread into the threaded opening 48 of the boss 46. Formed in the bottom and rear sides 58 and 62 is a channel 68 that is shaped and configured so as to receive the boss 46 when the stuffer block 50 is secured within the fuel bowl housing 12. Typically, lateral recesses 70 are provided along both sides of the channel 68 to further provide clearance for the inner contours of the fuel bowl housing 12.

When positioned within the fuel bowl housing 12 in the manner described above, the stuffer block 50 recaptures the volume of space gained by the user with the inclusion of the supplemental fuel storage area 44. Accordingly, stuffer blocks 50 constructed in accordance with the present invention allow the user to reduce the capacity of one or more of the fuel bowls 10 in situations when the additional capacity would not increase performance and could instead create one or more of the performance problems associated with high capacity fuel bowls discussed above. Moreover, the stuffer blocks 44 are removable such that the user can use them for one particular application and then can remove them for another application. Therefore, the fuel bowl 10 and stuffer block 50 together give the user increased flexibility of use.

Figure 8:
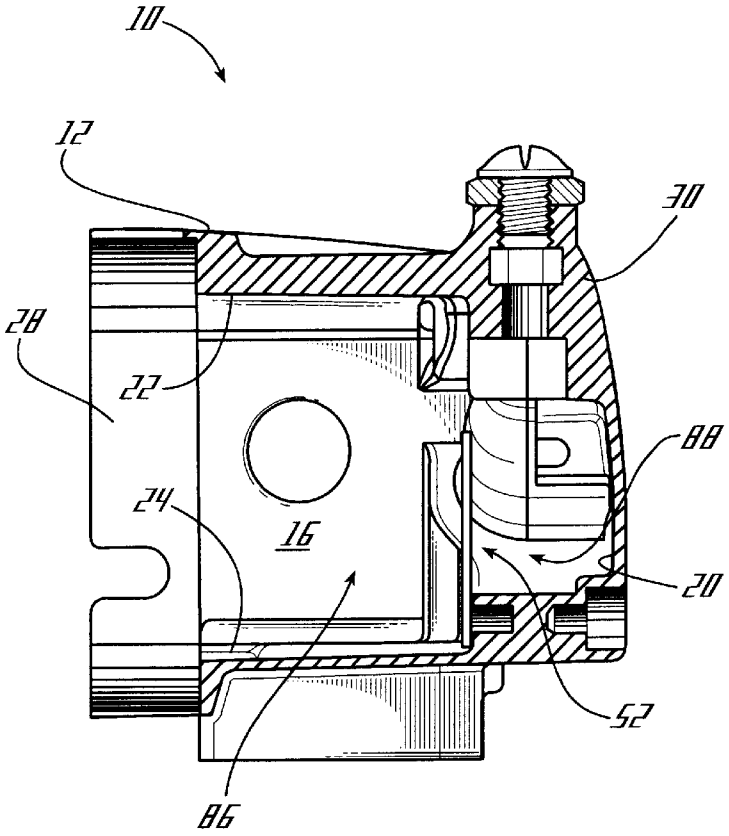
FIG. 8 is a partial cross-sectional side view of the fuel bowl shown in FIG. 7 taken along lines 8—8.
Figure 7:
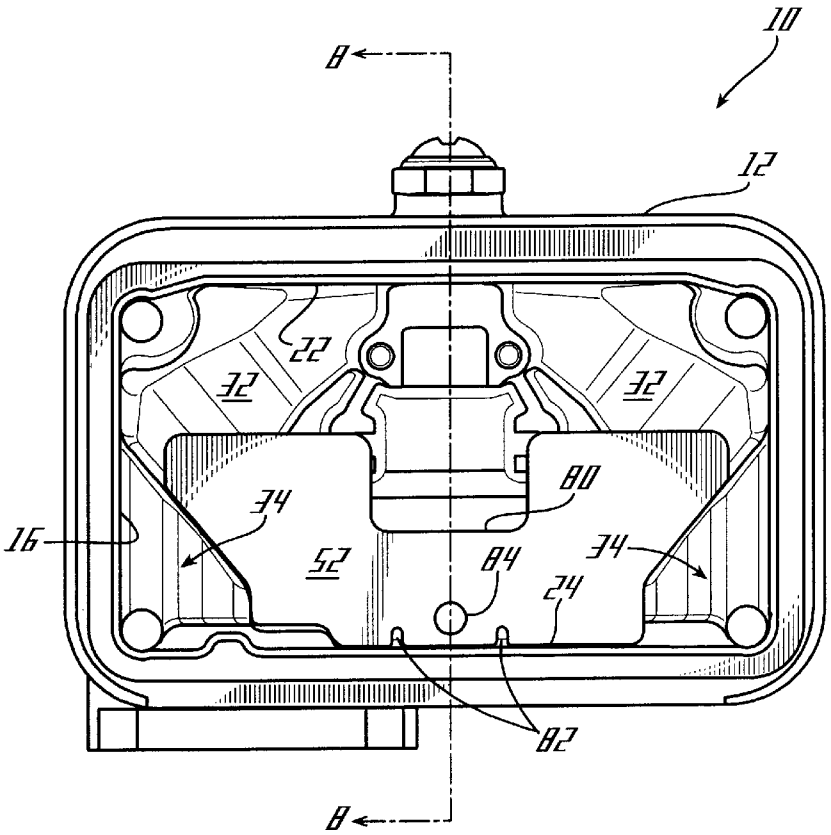
FIG. 7 is a front view of the fuel bowl shown in FIG. 1 provided with a fuel dam.
Figure 9:
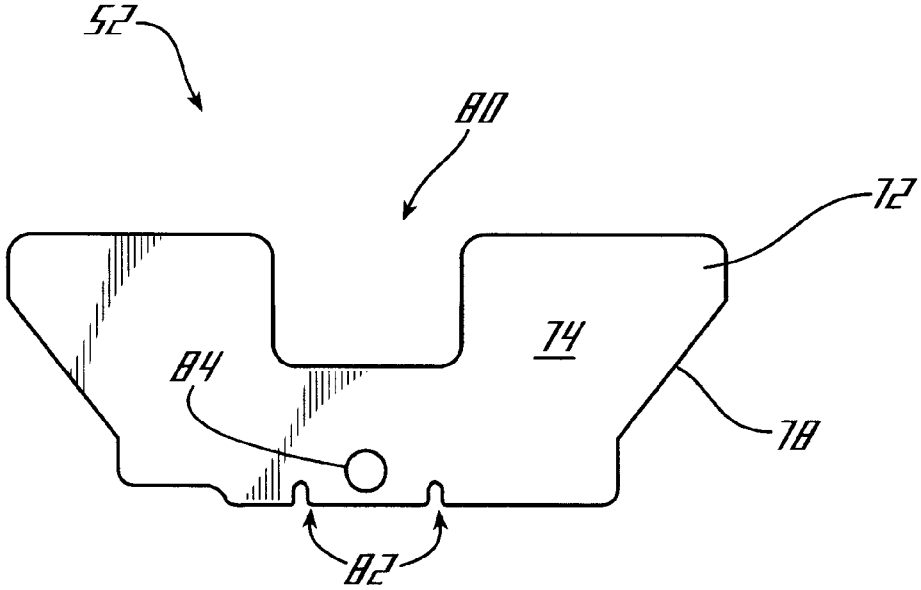
FIG. 9 is a front view of the fuel dam shown in FIGS. 7–8.
Figure 10:
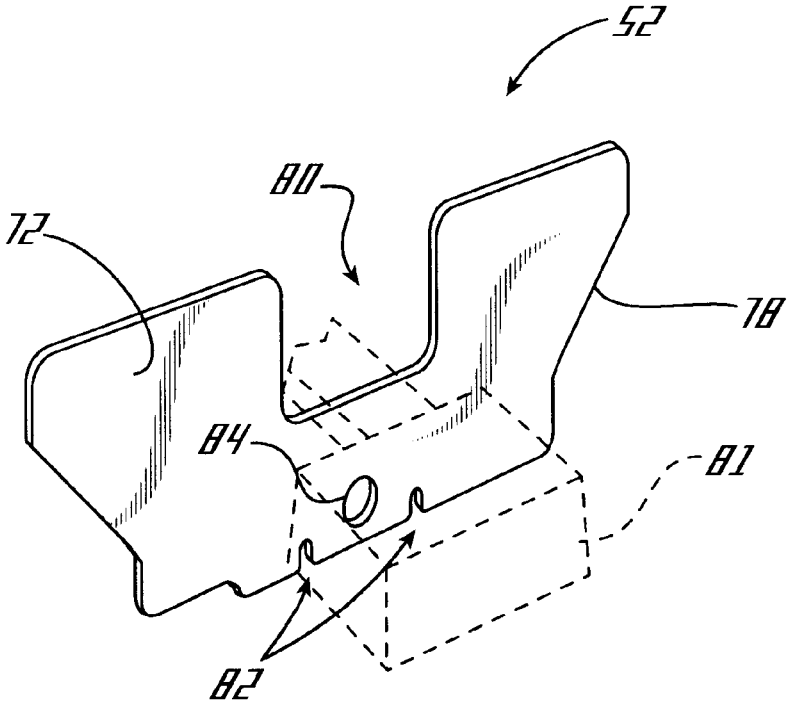
FIG. 10 is a perspective view of the fuel dam shown in FIG. 9.

As an alternative to the stuffer block 50 described above, the fuel bowl 10 of the present invention can be provided with a fuel dam 52. FIGS. 7 and 8 show the fuel bowl 10 fitted with the fuel dam 52. As indicated in these figures, the fuel dam 52 can be positioned inside the inner fuel cavity 14 of the fuel bowl housing 12 such that it extends from one comer structure 34 to the other. As illustrated in FIGS. 9 and 10, the fuel dam 52 comprises a substantially planar body 72 defined by front and rear sides 74 and 76 and an outer periphery 78. As indicated in FIG. 7, the lateral edges of the outer periphery 78 are shaped and configured to trace the contours of the comer sstructures 34. Formed along the top edge of the outer periphery 78 is a central notch 80 that provides clearance for the operation of a float (not shown). Formed centrally in the bottom edges of the outer periphery 78 are fuel distribution slots 82, the purpose for which is explained below. Between these slots 82 is a fastener hole 84 which serves a purpose similar to that of the stuffer block 50.

When positioned within the fuel bowl housing 12 in the manner described above, the fuel dam 52 divides the inner fuel cavity 14 into a primary cavity 86 and a secondary cavity 88 as indicated in FIG. 8. During carburetor operation, the primary cavity 86 functions as a standard fuel bowl, supplying the needed fuel to its associated metering block. However, in high demand situations in which the fuel contained in the primary cavity 86 is unavailable or already has been used, the fuel stored behind the fuel dam 52 is supplied to the primary cavity 86 and, thereby to the metering block, via the fuel distribution slots 82. This supplemental supply of fuel is particularly useful in situations involving lateral acceleration in that fuel can be supplied to the centrally located inlet jets of the metering block by the secondary cavity 88 via the fuel distribution slots 82 when the fuel in the primary cavity 86 has migrated to the side of the fuel bowl housing 12.

While preferred embodiments of the invention have been disclosed in detail in the foregoing description and drawings, it will be understood by those skilled in the art that variations and modifications thereof can be made without departing from the spirit and scope of the invention as set forth in the following claims.

What is claimed is:

1. A fuel bowl having increased fuel carrying capacity for mounting to a carburetor and a metering block, said fuel bowl comprising:

a fuel bowl housing forming an inner fuel chamber in which fuel to be supplied to a carburetor can be held, said fuel bowl chamber having an open face for engagement with a fuel metering block mounted to a carburetor;

a float valve positioned in said inner fuel chamber for controlling the flow of fuel from said inner fuel chamber to a metering block;

said fuel bowl housing defining a supplemental fuel chamber positioned adjacent said inner fuel chamber which opens into said inner fuel chamber and stores supplemental fuel and feeds the supplemental fuel to said inner fuel chamber; and a stuffer block shaped for positioning in and occupying space in said supplemental fuel chamber for reducing the space in said supplemental fuel chamber for fuel, said stuffer block including a fastener for removably holding said stuffer block in said supplemental fuel chamber.

2. The fuel bowl of claim 1, wherein said fuel bowl housing includes a fastener hole for the attachment of said fastener to said fuel bowl housing.

3. The fuel bowl of claim 1, wherein said stuffer block has a surface shaped to accept the movement of a float mounted inside said inner fuel chamber.

4. The fuel bowl of claim 1, wherein said stuffer block has an external shape that approximately conforms to the shape of said supplemental fuel chamber.

5. The fuel bowl of claim 1, wherein said fuel bowl housing includes a boss that protrudes into said supplemental fuel chamber, and said stuffer block fastener is mounted to said boss, and said stuffer block defines a recess for straddling said boss.

6. A fuel bowl having increased fuel carrying capacity for mounting to a carburetor and a metering block, said fuel bowl comprising:

a fuel bowl housing forming an inner fuel chamber in which fuel to be supplied to a carburetor can be held, said fuel bowl chamber having an open face for engagement with a fuel metering block mounted to a carburetor;

a float valve positioned in said inner fuel chamber for controlling the flow of fuel from said inner fuel chamber to a metering block;

said fuel bowl housing defining a supplemental fuel chamber positioned adjacent said inner fuel chamber which opens into said inner fuel chamber and stores supplemental fuel and feeds the supplemental fuel to said inner fuel chamber;

a fuel dam for positioning between said inner fuel chamber and said supplemental fuel chamber, said fuel dam having a perimeter edge which substantially conforms to the shape of said inner fuel chamber.

7. The fuel bowl of claim 6, wherein said fuel bowl housing includes a fastener hole for the attachment of said fuel dam to said fuel bowl housing.

8. The fuel bowl of claim 6, wherein said fuel dam defines openings therethrough for the passage of fuel therethrough.

9. The fuel bowl of claim 6, wherein said fuel bowl housing includes a boss that protrudes into said supplemental fuel chamber, and said fuel dam is mounted to said boss.

10. The fuel bowl of claim 6, wherein said fuel dam defines a notch for receiving the movement of a float valve positioned in said fuel bowl housing.

11. A fuel bowl having increased fuel carrying capacity, comprising:

a fuel bowl housing that forms an inner fuel cavity in which fuel to be supplied to a carburetor can be held, said fuel bowl housing having an open-faced configuration;

said fuel bowl including a supplemental fuel storage chamber in communication with said inner fuel cavity that is capable of storing supplemental fuel and feeding the supplemental fuel to the inner fuel cavity, and a stuffer block removably positioned in said supplemental fuel storage chamber for reducing the space for storing fuel in said supplemental fuel storage chamber.

12. A fuel bowl having increased fuel carrying capacity, comprising:

a fuel bowl housing that forms an inner fuel cavity in which fuel to be supplied to a carburetor can be held, said fuel bowl housing having an open-faced configuration;

said fuel bowl including a supplemental fuel storage chamber in communication with said inner fuel cavity that is capable of storing supplemental fuel and feeding the supplemental fuel to said inner fuel cavity; and a fuel dam positioned between said inner fuel cavity and said supplemental fuel storage chamber for regulating the flow of fuel between said inner fuel cavity and said supplemental fuel storage chamber.

* * * * *